United States Patent [19]

Simons et al.

[11] 4,015,665

[45] Apr. 5, 1977

[54] CONCEALED SPRINKLER HEAD

[75] Inventors: John R. Simons, Delavan; John W. Fenske, Wauwatosa, both of Wis.

[73] Assignee: Grunau Company, Inc., Milwaukee, Wis.

[22] Filed: Aug. 7, 1975

[21] Appl. No.: 602,831

[52] U.S. Cl. ..... 169/40; 169/42

[51] Int. Cl.[2] ..... A62C 37/06; A62C 37/12

[58] Field of Search ..... 169/37, 38, 39–42

[56] References Cited

UNITED STATES PATENTS

| | | | |
|---|---|---|---|
| 1,606,311 | 11/1926 | MacGregor | 169/40 |
| 2,004,833 | 6/1935 | Rowley | 169/38 |
| 2,389,331 | 11/1945 | Tyden | 169/37 |
| 2,389,334 | 11/1945 | Tyden | 169/40 |
| 3,195,647 | 7/1965 | Campbell et al. | 169/37 X |
| 3,756,321 | 9/1973 | Gloeckler | 169/40 |

*Primary Examiner*—Evon C. Blunk
*Assistant Examiner*—Andres Kashnikow
*Attorney, Agent, or Firm*—Andrus, Sceales, Starke & Sawall

[57] ABSTRACT

An improved concealed sprinkler head for an automatic sprinkler system. The sprinkler head includes an orifice body that is mounted above the ceiling of the building and is connected to the water line. The body has an outlet which is normally enclosed by a valve cap, and the cap is held in the closed position by a latch assembly which includes a latch bar. One end of the latch bar is provided with a projection which engages an abutment on the orifice body while the opposite end of the latch bar is provided with a recess which contains a fusible metallic element, and a movable member, such as a ball or a series of balls, is engaged with the fusible element and projects outwardly from the latch bar and is engaged with a second abutment on the orifice body. The latch bar carries a decorative plate that is mounted flush against the ceiling and has a series of openings to provide improved heat transfer to the fusible element. When exposed to an elevated temperature, the fusible element will melt and spring pressure will force the movable member inwardly of the recess to release the latch bar and open the valve cap.

3 Claims, 7 Drawing Figures

CONCEALED SPRINKLER HEAD

BACKGROUND OF THE INVENTION

The conventional automatic sprinkler head is connected to a water line and includes a body or frame that has an outlet orifice which is normally closed by a cap, and the cap is held in the closed position by a lever assembly which includes a low melting point fusible element. When the ambient temperature is increased to a predetermined level, the element will melt, releasing the lever assembly to open the orifice and discharge the water.

In residential dwellings and commerical buildings, it is often desired to utilize a sprinkler head that is located above the ceiling so that the operative parts are not exposed to view. In some cases, the sprinkler head is mounted within a recess in the ceiling, and while the sprinkler head does not depend from the ceiling, the operative parts are not completely concealed.

In other instances the sprinkler head is concealed within the ceiling by a decorative plate which is mounted flush against the ceiling so that none of the operative parts are visible.

In some concealed sprinkler head installations, such as disclosed in U.S. Pat. Nos. 3,633,676 and 3,714,989, the decorative plate is attached to the sprinkler head by a fusible material, and when the fusible material melts, the decorative plate is released to expose the fusible element of the lever assembly. Sprinkler heads of this variety have a disadvantage in that two separate fusible release mechanisms are required, one to release the decorative plate to expose the fusible element of the lever assembly, and the second to release the lever assembly to open the orifice.

With either the recessed or concealed types of sprinkler head, the rate of heat transfer to the fusible element is reduced so that recessed and concealed types of sprinkler heads generally have a slower response rate than the exposed type of sprinkler head.

SUMMARY OF THE INVENTION

The invention relates to an improved concealed, automatic sprinkler head. The sprinkler head includes an orifice body which is located above the ceiling and is connected to the water line. The lower end of the orifice body defines an outlet opening which is normally enclosed by a valve cap formed integrally with a seal or gasket. The valve cap is held in the closed position by a compression screw which is threaded within an opening in a latch bar. One end of the latch bar is provided with a projection which engages an abutment on the annular flange of the orifice body, while the opposite end of the latch bar is provided with a recess that contains a fusible element. A ball bears against the fusible element and projects outwardly beyond the end of the latch bar and is engaged with the abutment on the orifice body. Urging the latch bar downwardly is a compression spring that is interposed between the cap and the latch bar.

Formed integrally with the latch bar is a decorative plate which is located generally flush with the ceiling and conceals the operative parts of the sprinkler head. A series of openings are formed in the decorative plate to improve the heat transfer to the fusible element. A decorative ring is threaded on the annular flange of the orifice body and borders the decorative plate.

If the ambient temperature rises to a predetermined level, the fusible element will melt and the force of the compression spring will act to wedge the ball inwardly of the latch bar to thereby release the latch bar and open the outlet opening. The valve cap and deflector will fall downwardly and are retained in a lower position, where the water being discharged from the outlet opening will be deflected outwardly by the deflector plate in the desired spray pattern.

In a modified form of the invention, the latch bar has a projection on one end which engages the abutment on the flange of the orifice body, while the opposite end of the latch bar is provided with a bore or recess which communicates with a vertical opening in the latch bar. A housing, containing a fusible element, is threaded into the opening in the latch bar so that the housing in conjunction with the bore provides a generally L-shaped passage that contains a series of balls. The innermost ball is engaged with the fusible element while the outermost ball is engaged with the abutment on the orifice body flange to retain the latch bar in the latch position.

A decorative plate is threaded on the housing that contains the fusible element and the lower end of the housing is exposed and projects slightly below the plate.

When the ambient temperature rises, the fusible element in the exposed housing will melt, and the force of the spring will move the balls inwardly, thereby releasing the latch bar so that the valve cap and deflector plate will drop to open the outlet opening.

The invention provides an improved concealed sprinkler head in which all of the operative parts are located above the ceiling and the only portions exposed to view are decorative items.

The sprinkler head has an improved rate of heat transfer to the fusible element as compared with concealed type sprinkler heads as used in the past, thereby providing a faster response rate.

The sprinkler head is also considerably less expensive to manufacture than types used in the past as it contains a lesser number of working parts.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
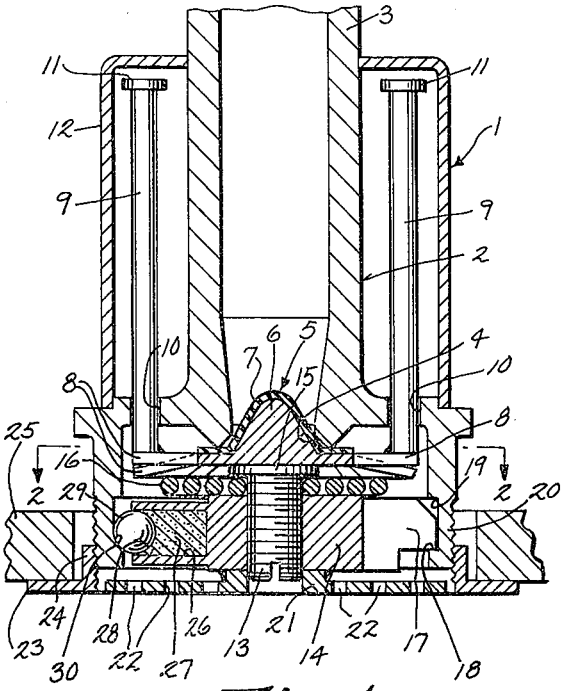
FIG. 1 is a vertical section showing the sprinkler head of the invention as mounted above the ceiling of a building.

FIGS. 1–4 illustrate a concealed type automatic sprinkler head 1 which is composed of an orifice body 2 having an upper end 3 that is adapted to be connected to a water line. The lower end of the orifice body defines an outlet 4 which is normally enclosed by a valve cap assembly 5. Valve cap assembly 5 includes a generally conical valve 6 which along with the gasket or sealing member 7 is adapted to seal the outlet 4 in the orifice body.

The outer portion of the valve cap assembly 5 is adapted to function as a deflector plate when the valve cap is released and includes a series of fingers or tines 8. Two of the tines 8 extend outwardly at diametrically opposite locations from the central valve 6 and are located in a generally horizontal plane. Guide rods 9 are connected to the horizontal tines and the rods are mounted for sliding movement within holes 10 formed in the orifice body. The upper ends of the rods 9 are provided with enlarged heads 11 which, when the valve cap assembly 5 is released, will engage the orifice body to prevent complete displacement of the valve cap assembly 5. The rods are located with a cup-shaped casing 12 which is connected to the orifice body 2.

Figure 3:
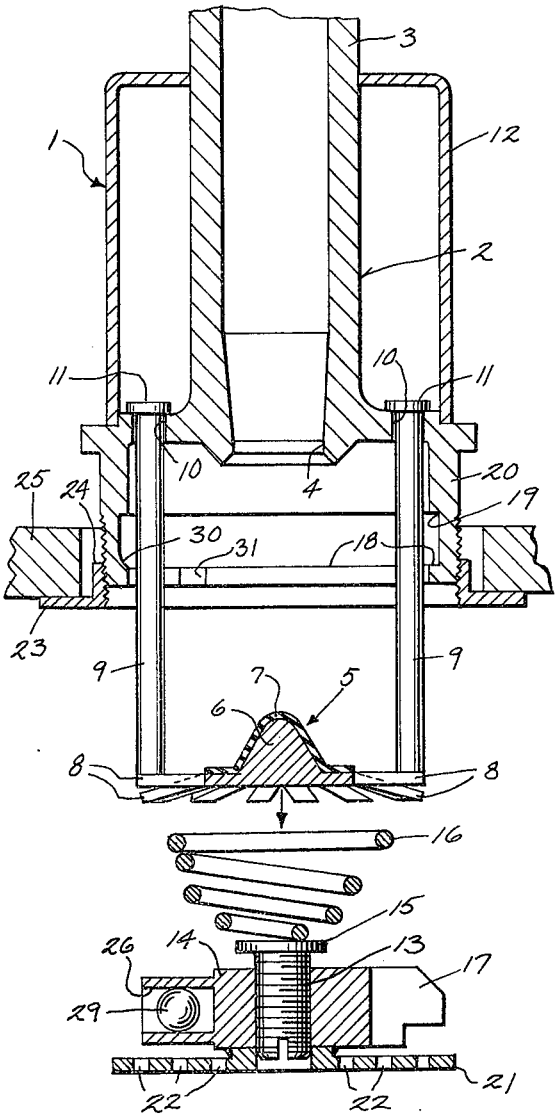
FIG. 3 is a view similar to FIG. 1 showing the valve cap and the latch mechanism in the released position.
Figure 2:
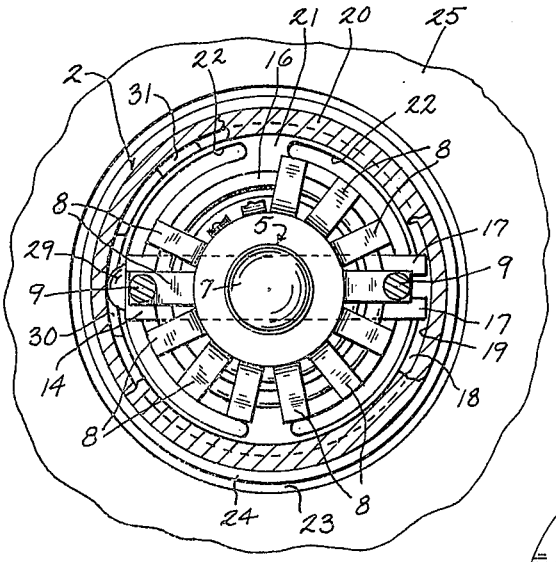
FIG. 2 is a section taken along line 2—2 of FIG. 1 with parts broken away.

As shown in FIGS. 1 and 3, the tines 8 which are not connected to rod 9 extend downwardly at a slight angle to provide the desired spray pattern of water when the valve cap assembly is released.

The valve cap assembly 5 is normally retained in the closed position by a compression screw 13 which is threaded within a latch bar 14, and the upper enlarged head 15 of the compression screw bears against the valve cap assembly 5. As best shown in FIG. 1, a spiral compression spring 16 is interposed between the latch bar 14 and the tines 8 of the valve cap assembly 5 and the spring 16 exerts a downward force against the latch bar.

Figure 4:
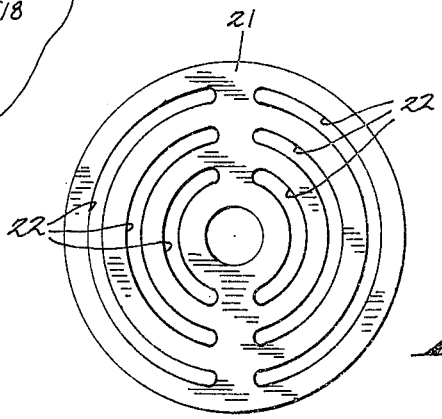
FIG. 4 is a plan view of the decorative plate.

One end of the latch bar 14 is forked and is formed with a pair of projections 17 which are adapted to engage the annular lip or abutment 18 which borders the lower edge of a circumferential groove 19 formed in the downwardly extending flange 20 of orifice body 2. Secured to the lower surface of the latch bar is a generally circular decorative plate 21 having a series of openings 22. As shown in FIG. 4, the openings are in the form of a series of curved apertures, but it is contemplated that the openings can take any desired pattern or configuration.

Located outwardly of the decorative plate 21 is a ring 23 having an annular flange 24 that is threaded with the flange 20 of the orifice body 2. By threading the ring 23 on the orifice body flange 20, the ring can be brought into tight bearing engagement with the ceiling 25 of the building.

The end of the latch bar 14 opposite from the projections 17 is provided with a bore or recess 26, which contains a slug 27 of a low melting point, fusible alloy, such as solder. The fusible element 27 is designed to melt at a temperature generally in the range of about 135° to 180° F as in a conventional automatic sprinkler head.

As shown in FIG. 1, the outer end of the fusible element 27 is formed with a depression or socket 28 and a ball 29 is located within the socket and projects outwardly beyond the end of the latch bar 14. The ball 29 is engaged with the lip or abutment 18 on the flange 20 of the orifice body 2. The portion of the lip which receives the ball is provided with a fillet 30, as best shown in FIG. 1. With this construction, the projections 17 at one end of the latch bar 14 will be engaged with the abutment 18 while the ball 29 protruding from the opposite end of the latch bar will also be engaged with the lip 18 at a diametrically opposite position to thereby maintain the latch bar in the latched position.

To aid in assembling the latch bar, the lower end of the orifice body flange 20 is provided with an axially extending notch 31. The ball 29 is moved up the notch until the ball is positioned above the lip or abutment 18. The latch bar 14 is then rotated to move the ball 29 out of registry with the notch 31 and to position the ball in the area of the fillet 30. The screw 13 is then threaded upwardly in latch bar 14 to move the valve 6 in tight sealing engagement with the valve seat 4.

The decorative plate 21 serves to conceal the operating parts of the sprinkler head and the openings 22 in the decorative plate aid in increasing the rate of heat transfer to the fusible element 27. When the temperature rises to the melting point of the element 27, the element will melt and the force of the compression spring 16, which is acting downwardly, will wedge the ball 29 inwardly of the recess 26, thereby snapping the ball over the edge of the lip or abutment 18 to release the latch bar.

When the latch bar 14 is released, valve cap assembly 5 will drop to open the orifice and discharge water. The heads 11 on the ends of the rods 9 will limit the downward movement of the valve cap assembly so that the water being discharged from the orifice will strike the deflector tines 8 and be deflected outwardly in the desired spray pattern.

Figure 5:
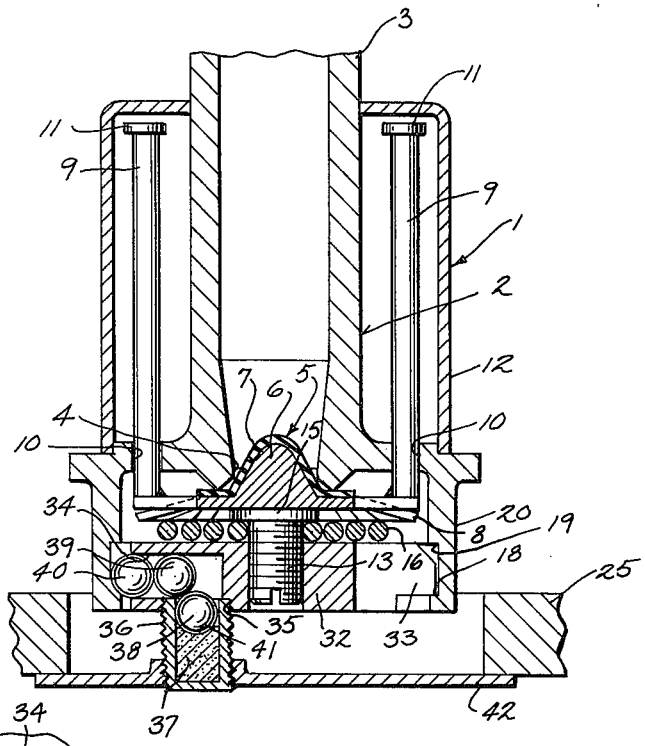
FIG. 5 is a vertical section of a modified form of the invention.
Figure 6:
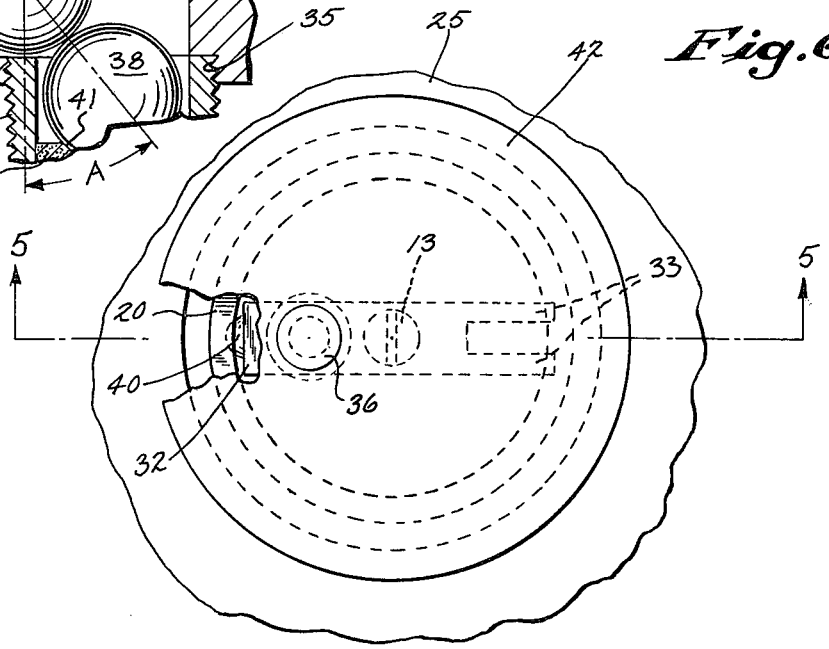
FIG. 6 is a bottom view of the sprinkler head of FIG. 5 with parts broken away.

FIGS. 5 and 6 illustrate a modified form of the invention in which the latch bar has a modified construction. As shown in FIG. 5, the latch bar 32 has a forked end which terminates in a pair of projections 33 which engage the annular shoulder or abutment 18 on the flange 20 of the orifice body 2, similar to the manner described with respect to the first embodiment. The opposite end of the latch bar 32 is formed with a bore or recess 34 which communicates with a downwardly extending threaded opening 35. A housing 36, which contains a fusible element 37, similar to the fusible element 27 of the first embodiment, is threaded within the opening 35.

The housing 36, in combination with the recess 34, defines an L-shaped passage and three balls 38, 39 and 40 are located within the passage. The innermost ball 38 is received within a depression or socket 41 in the upper end of the fusible element 37, while the outermost ball 40 is engaged with the annular lip or abutment 18 formed in the flange 20 of the orifice body 2.

Thus, the latch bar 32 is retained in position by engagement of the projections 33 with the lip 18 and the engagement of the outermost ball 40 with the lip 18 at a diametrically opposite location.

A decorative plate 42 is threaded on the housing 36 until the periphery of the plate engages the lower surface of the ceiling 25, as shown in FIG. 5.

Figure 7:
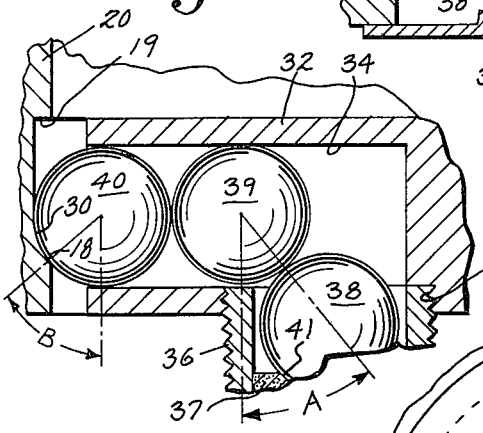
FIG. 7 is an enlarged fragmentary vertical section showing the relationship of the three balls.

In assembling the sprinkler head of FIGS. 5–7, the housing 36 is loosely threaded to the latch bar 32 so that the outermost ball 40 will be in a position where it will ride up the inner wall of flange 20. The housing 36 is then threaded upwardly in opening 35 causing ball 40 to move outwardly into tight engagement with the fillet 30 of abutment 18.

As the housing 36 is threaded upwardly into the threaded opening 35, a force will be exerted through the balls 38, 39 and 40, against the flange 20 of the orifice body 2. This adjustment serves locate the outermost ball 40 with respect to the abutment 18 or lip and serves to compensate for any irregularities in the size of the balls or the mass of the fusible element. The construction also facilitates installation of the latch bar and eliminates the need of machining an entry, such as groove 31 of the first embodiment, in the flange 20 of the orifice body.

As the housing 36 projects downwardly below the decorative plate 42, the fusible element 37 will be in an exposed position so that the response rate is substantially improved over units in which the fusible element is located well above the ceiling. When the ambient temperature rises above the melting point of the element 37, the element will melt and the force of the spring 16 will act to wedge the outermost ball 40 inwardly of the recess 34 to thereby enable the ball 40 to snap over the lip 18 and release the valve cap assembly 5 to open the orifice. The inward force exerted by ball 40 against the ball 39 will be transmitted to ball 38, causing ball 38 to move downwardly within the housing 36 and the molten metal will flow upwardly around the ball 38 into the bore or recess 34. To provide the wedging type of action, the angle A (the angle between a vertical line passing through the center of ball 39 and a line passing from the center of ball 39 to the point of tangency between balls 38 and 39), as shown in FIG. 7, should be less than 45° and the angle B (the angle between a vertical line passing through the center of ball 40 and a line extending between the center of ball 40 and lip 18) should be greater than 45°. With this angular relationship, the force of the spring 16 will act to move the balls inwardly of the recess on melting of the fusible element to release the assembly.

The operative parts of the sprinkler head of the invention are all completely concealed above the ceiling. The only exposed portions being the decorative plate 21 and ring 23, in the case of the embodiment of FIGS. 1–4, and the decorative plate 42 and the lower end of the housing 35, in the case of the sprinkler head of FIGS. 5 and 6. In the embodiment of FIGS. 1–4, the fusible element is located immediately above the decorative plate and the plate is provided with a series of openings which increase the rate of heat transfer to the fusible element, while in the embodiment shown in FIGS. 5 and 6, the fusible element is located within the housing 36 which projects downwardly beneath the decorative plate. Thus, the rate of heat transfer to the fusible element is increased over conventional concealed sprinkler heads, resulting in a faster rate of response.

Various modes of carrying out the invention are contemplated as being within the scope of the following claims particularly pointing out and distinctly claiming the subject matter which is regarded as the invention.

We claim:

1. An automatic sprinkler head to be mounted above the level of a ceiling in a building, comprising an orifice body having an inlet to be connected to a water line and having a discharge outlet, a valve cap assembly to enclose the outlet and including deflector means, said deflector means acting to deflect the water being discharged from said outlet in a desired spray pattern when said valve cap assembly is moved to the open position, latch means disposed in engagment with said valve cap assembly to maintain said assembly in the closed position, one end of said latch means defining a projection, first abutment means formed on said orifice body and disposed to be engaged by said projection, said latch means having a recess located in spaced relation to said projection, said recess having a generally horizontal axis, said latch means includes a vertical opening communicating with the inner end of said recess, a tubular housing connected to said opening and projecting downwardly from said latch means, a fusible element disposed within said housing and adapted to melt at a predetermined elevated temperature, a series of balls disposed within said housing and said recess, the innermost of said series of balls being disposed in engagement with said fusible element, second abutment means formed on the orifice body and spaced from said first abutment means, the outermost of said series of balls being engaged with said second abutment means, and a decorative plate carried by said housing and adapted to bear against the undersurface of the ceiling, said housing projecting downwardly beyond said plate, melting of said fusible element resulting in said outermost ball being moved inwardly of said recess to release said latch means and open said discharge outlet.

2. An automatic sprinkler head adapted to be located above the level of a ceiling in a building, comprising an orifice body having an inlet passage to be connected to a water line and having a water outlet, a valve cap assembly to enclose the water outlet, latch means engaged with the valve cap assembly to hold the valve cap assembly in a closed position, said latch means including a projection, first abutment means located on the orifice body to be engaged by said projection, said latch means having a recess, a fusible element located within the recess and disposed to melt at a predetermined temperature, a movable member engaged with the fusible element and projecting beyond said latch means, second abutment means formed on said orifice body and disposed to be engaged by said movable member, whereby the latch means is retained in a latched position by engagement of said projection with said first abutment means and engagement of said movable member with said second abutment means, melting of said fusible element causing said movable member to be moved inwardly of said recess to thereby release engagement of said movable member from said second abutment means to release said valve cap assembly and open said outlet, said orifice body having a downwardly extending annular flange and said first and second abutment means comprising an internal shoulder on said flange, said internal shoulder being interrupted by a longitudinally extending notch adapted to receive the movable means on assembly of said latch means, said latch means being rotated after said movable means is positioned upwardly of said shoulder to move said latch means out of registry with said notch and into engagement with the shoulder.

3. The sprinkler head of claim 2, and including a rounded fillet located above said shoulder and spaced circumferentially from said notch, said movable member to be moved into engagement with the fillet on rotation of said latch means.

* * * * *